US009750343B2

(12) United States Patent
McBride et al.

(10) Patent No.: US 9,750,343 B2
(45) Date of Patent: Sep. 5, 2017

(54) EXERCISE DEVICE WITH ADJUSTABLE DESK

(71) Applicant: STAMINA PRODUCTS, INC., Springfield, MO (US)

(72) Inventors: Robert McBride, Springfield, MO (US); Tyler Rogers, Springfield, MO (US); Peter Ploss, Springfield, MO (US); Newton Lin, Springfield, MO (US); Taylor Hutchens, Springfield, MO (US)

(73) Assignee: Stamina Products, Inc., Springfield, MO (US)

( * ) Notice: Subject to any disclaimer, the term of this patent is extended or adjusted under 35 U.S.C. 154(b) by 5 days.

(21) Appl. No.: 14/883,251

(22) Filed: Oct. 14, 2015

(65) Prior Publication Data

US 2017/0105523 A1 Apr. 20, 2017

(51) Int. Cl.
*A63B 22/06* (2006.01)
*A47B 83/02* (2006.01)
(Continued)

(52) U.S. Cl.
CPC ..... *A47B 83/02* (2013.01); *A47B 21/02* (2013.01); *A47B 21/03* (2013.01); *A63B 22/0605* (2013.01); *A63B 23/03516* (2013.01)

(58) Field of Classification Search
CPC ..... A63B 69/16; A63B 2069/161–2069/168; A63B 22/0605; A63B 2022/0611;
(Continued)

(56) References Cited

U.S. PATENT DOCUMENTS 3,638,584 A 2/1972 Cisler et al.
4,660,817 A 4/1987 Kowalski
(Continued)

FOREIGN PATENT DOCUMENTS

CN 201105118 Y 8/2008
CN 203989700 U 12/2014

OTHER PUBLICATIONS

Laptop Workout Desk and Exercise Bike, Sharper Image; URL: <http://www.sharperimage.com/si/view/product/Laptop-Workout-Desk-And-Exercise-Bike/202052>.
FitDesk website; URL: <http://thefitdesk.com>.

*Primary Examiner* — Sundhara Ganesan
*Assistant Examiner* — Rae Fischer
(74) *Attorney, Agent, or Firm* — Pillsbury Winthrop Shaw Pittman LLP

(57) ABSTRACT

An exercise device includes a frame assembly having a base portion constructed and arranged to engage a surface, a first frame member and a second frame member, a seat, a crank pedal mechanism, an adjustable desk, and an actuator. The second frame member is configured to movable between a first position in which the desk is positioned closer to the seat so as to allow the user seated on the seat to use the desk and a second position in which the desk is positioned away from the seat so as to allow the user to stand upright on the surface with the user's body positioned between the seat and the desk to use the desk in a standing position. The actuator is constructed and arranged to be actuated to enable the second frame member to be moved between the first position and the second position.

19 Claims, 8 Drawing Sheets

(51) Int. Cl.
*A63B 23/035* (2006.01)
*A47B 21/02* (2006.01)
*A47B 21/03* (2006.01)

(58) Field of Classification Search
CPC .... A63B 2022/0617; A63B 2022/0623; A63B 2022/0629; A63B 2022/0635; A63B 2022/0641; A63B 2022/0647; A63B 2022/0652; A63B 2022/0658
See application file for complete search history.

(56) References Cited

U.S. PATENT DOCUMENTS

| | | | | |
|---|---|---|---|---|
| 5,284,131 | A | 2/1994 | Gray | |
| 5,813,947 | A | 9/1998 | Densmore | |
| 5,868,079 | A | 2/1999 | Charny | |
| 6,945,917 | B1 | 9/2005 | Baatz | |
| 7,335,147 | B2 | 2/2008 | Jones et al. | |
| 7,497,812 | B2 | 3/2009 | Neff et al. | |
| 7,677,678 | B2 | 3/2010 | Mosel et al. | |
| 7,686,742 | B2 * | 3/2010 | Tischler | A63B 71/00 108/8 |
| 7,823,973 | B2 | 11/2010 | Dragusin | |
| 8,485,945 | B2 | 7/2013 | Leonhard | |
| 8,876,661 | B2 | 11/2014 | Lu | |
| 8,876,662 | B2 | 11/2014 | Hao | |
| 8,920,292 | B1 | 12/2014 | Myers et al. | |
| 2003/0008752 | A1 | 1/2003 | Hsu | |
| 2005/0014609 | A1 | 1/2005 | Neff | |
| 2005/0054492 | A1 | 3/2005 | Neff | |
| 2006/0247109 | A1 | 11/2006 | Powell | |
| 2006/0264306 | A1 | 11/2006 | Tischler et al. | |
| 2013/0281274 | A1 | 10/2013 | Ferrusi et al. | |
| 2014/0024502 | A1 | 1/2014 | Watterson | |
| 2014/0073489 | A1 | 3/2014 | Wu | |
| 2014/0076206 | A1 | 3/2014 | McCabe | |

* cited by examiner

EXERCISE DEVICE WITH ADJUSTABLE DESK

BACKGROUND

Field

The present patent application relates to an exercise device with an adjustable desk, In order to promote good health and physical well-being, many individuals engage in a physical activity or exercise. It is common for individuals who are engaging in physical activities or exercises to use exercise devices or machines to assist in performing exercises. One type of exercise device or machine is a cycling device, such as a stationary "bicycle" which provides pedals on a crank subject to a resistive force, such that a user may cyclically move their feet to turn the pedals against the resistive force, to provide the workout. Other exercise devices or machines may include, but not limited to, elliptical exercise devices, cross-training devices or stair climbing devices. Some exercise devices are designed to be portable, and to be placed on a floor such that a user may engage the exercise device or machine with their legs. The present patent application provides improvements over the prior art exercise devices,

SUMMARY

One aspect of the present patent application provides an exercise device. The exercise device includes a frame assembly having a base portion constructed and arranged to engage a surface, a first frame member, and a second frame member; a seat; a crank pedal mechanism; an adjustable desk; and an actuator. The first frame member and the second frame member are connected to the base portion. The seat is constructed and arranged to be operatively connected to the first frame member and to support a user in a seated position, The crank pedal mechanism has pedals that are constructed and arranged to be movably connected to the frame assembly and to support the foot of the user, and a resistance mechanism that is constructed and arranged to be disposed on the frame assembly and apply resistance to the pedals. The adjustable desk is constructed and arranged to be operatively connected to the second frame member. The second frame member is configured to movable between a first position in which the desk is positioned closer to the seat so as to allow the user seated on the seat to use the desk and a second position in which the desk is positioned away from the seat so as to allow the user to stand upright on the surface with the user's body positioned between the seat and the desk to use the desk in a standing position, The actuator is constructed and arranged to be operatively associated with the second frame member and actuated to enable the second frame member to be moved between the first position and the second position.

These and other aspects of the present patent application, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures, In one embodiment of the present patent application, the structural components illustrated herein are drawn to scale. It is to be expressly understood, however, that the drawings are for the purpose of illustration and description only and are not intended as a definition of the limits of the present patent application. It shall also be appreciated that the features of one embodiment disclosed herein can be used in other embodiments disclosed herein. As used in the specification and in the claims, the singular form of "a", "an", and "the" include plural referents unless the context clearly dictates otherwise.

BRIEF DESCRIPTION OF THE DRAWINGS

Various embodiments will now be disclosed, by way of example only, with reference to the accompanying schematic drawings in which corresponding reference symbols indicate corresponding parts, in which.

DETAILED DESCRIPTION

Figure 1:
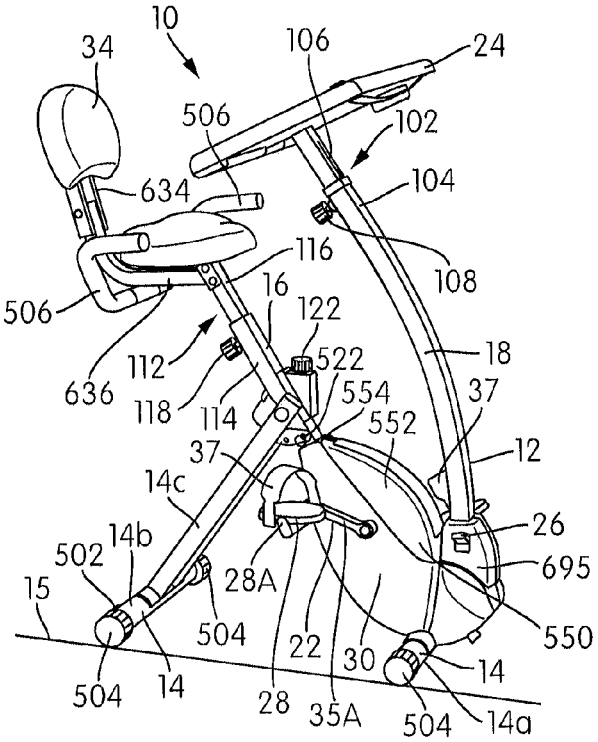
FIGS. 1, 1A and 2 show a left side perspective view, a detailed exploded view and a right side perspective view, respectively, of an exercise device in accordance with an embodiment of the present patent application.
Figure 2:
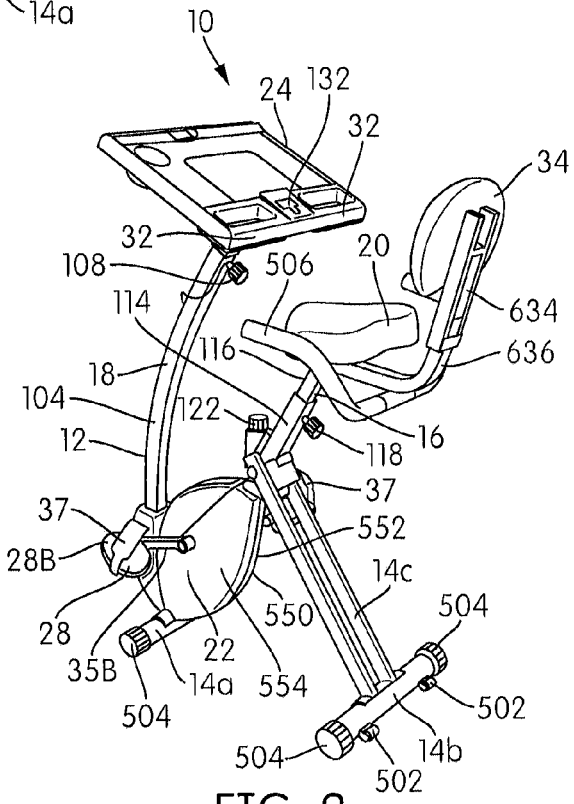
Figure 1A:
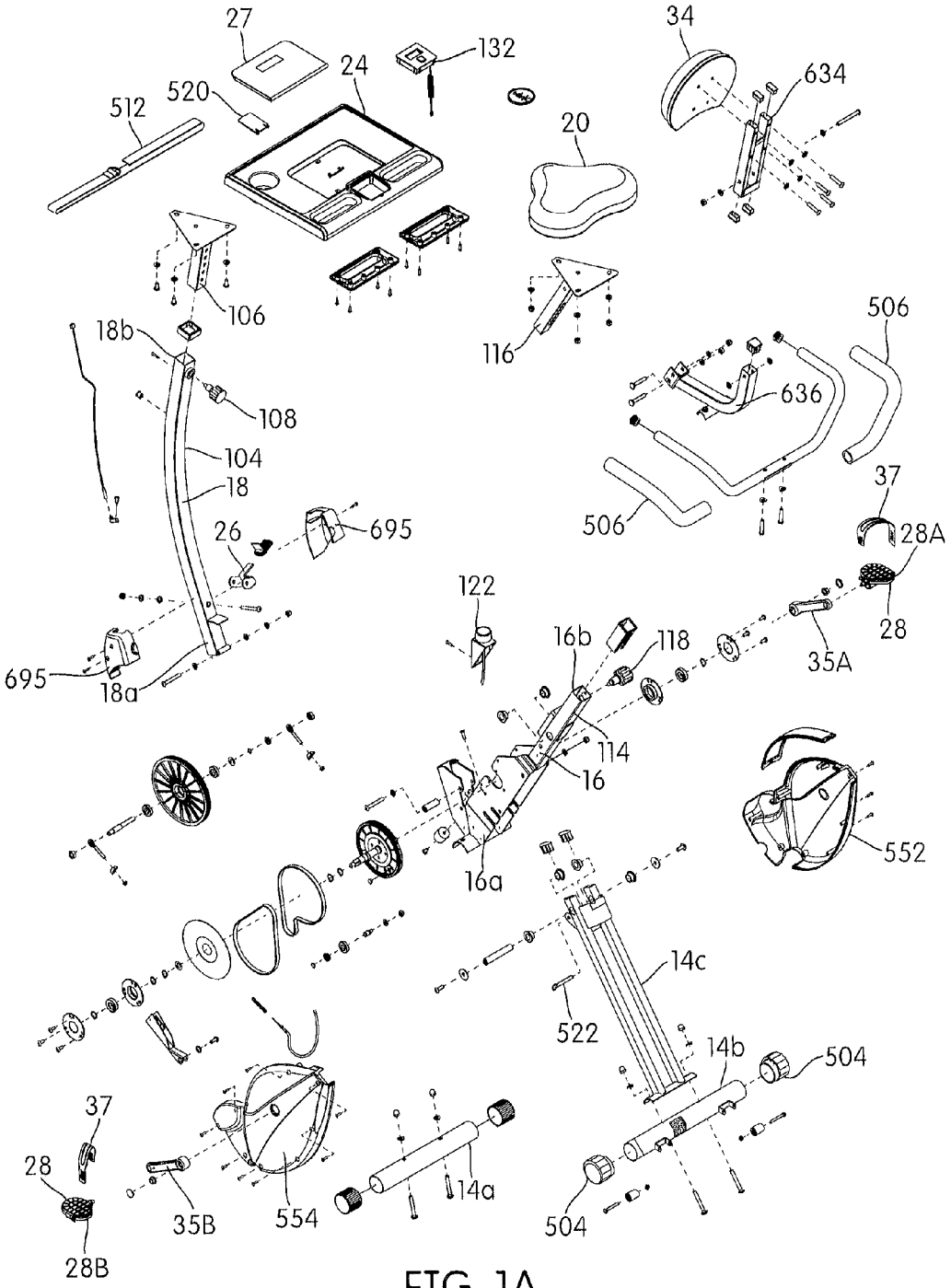

FIGS. 1, 1A and 2 show a left side perspective view, a detailed exploded view and a right side perspective view, respectively of an exercise device 10. The exercise device 10 includes a frame assembly 12 having a base portion 14 constructed and arranged to engage a surface 15, a first frame member 16, and a second frame member 18. The exercise device 10 also includes a seat 20, a crank pedal mechanism 22, an adjustable desk 24, and an actuator 26.

Figure 3:
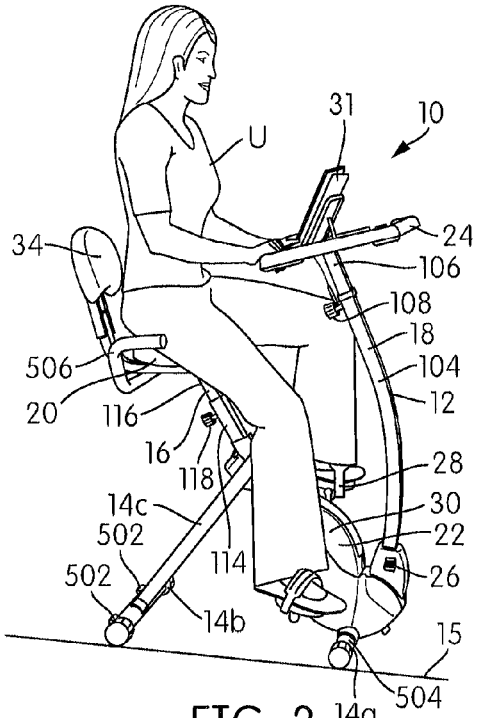
FIGS. 3 and 4 show a left side perspective view and a right side perspective view, respectively, of the exercise device, where a second frame member of the exercise device is in a first position in accordance with an embodiment of the present patent application.
Figure 4:
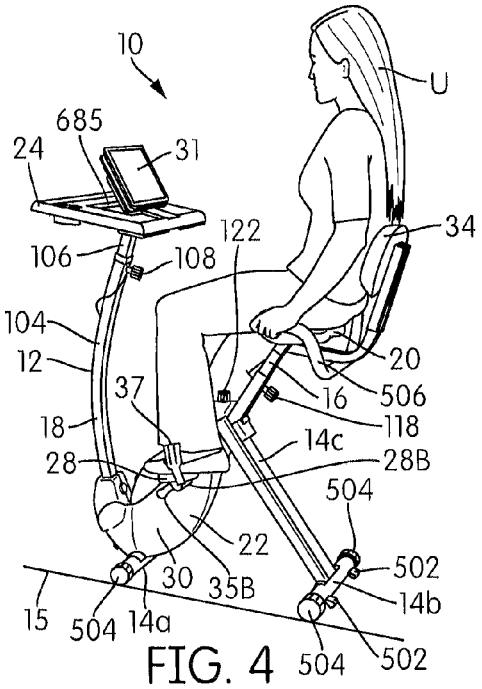
Figure 5:
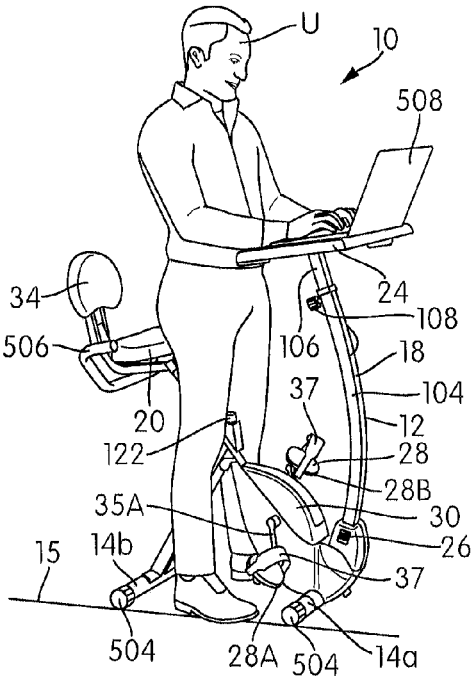
FIG. 5 shows a left side perspective view of the exercise device, where the second frame member of the exercise device is in a second position in accordance with an embodiment of the present patent application.

The first frame member 16 and the second frame member 18 are connected to the base portion 14. The seat 20 is constructed and arranged to be operatively connected to the first frame member 16 and to support a user U (as shown in FIGS. 3-5) in a seated position. The crank pedal mechanism 22 has pedals 28 that are constructed and arranged to be movably (e.g., rotatably) connected to the frame assembly 12 and to support the foot of the user U, and a resistance mechanism 30 that is constructed and arranged to be disposed on the frame assembly 12 and apply resistance to the pedals 28.

Figure 6:
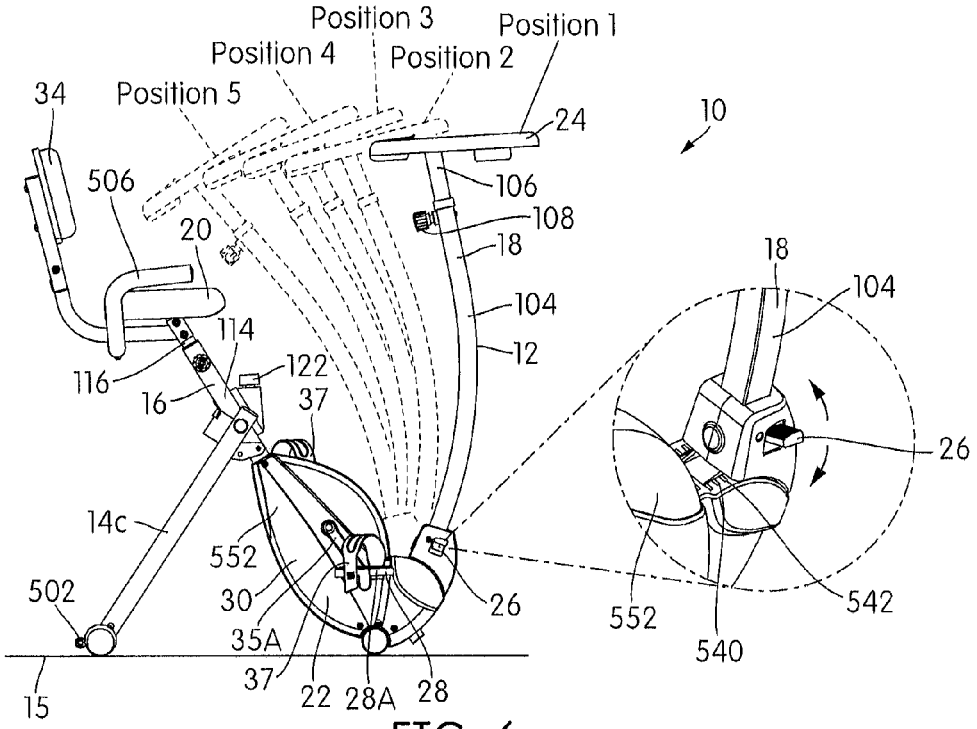
FIG. 6 shows a left side elevational view of the exercise device, where the second frame member of the exercise device is moved through a range of positions between the first and second positions and where the detailed view of FIG. 6 shows a position indicator for indicating the position of the second frame member in accordance with an embodiment of the present patent application.
Figure 7:
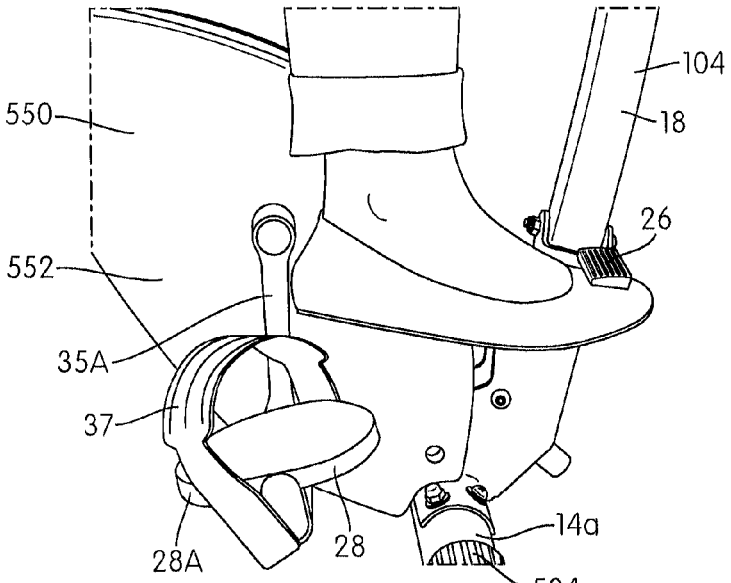
FIG. 7 shows a partial, left side perspective view of the exercise device, where an actuator of the exercise device is actuated by the user to enable the second frame member to be moved between the first and second positions in accordance with an embodiment of the present patent application.
Figure 8:
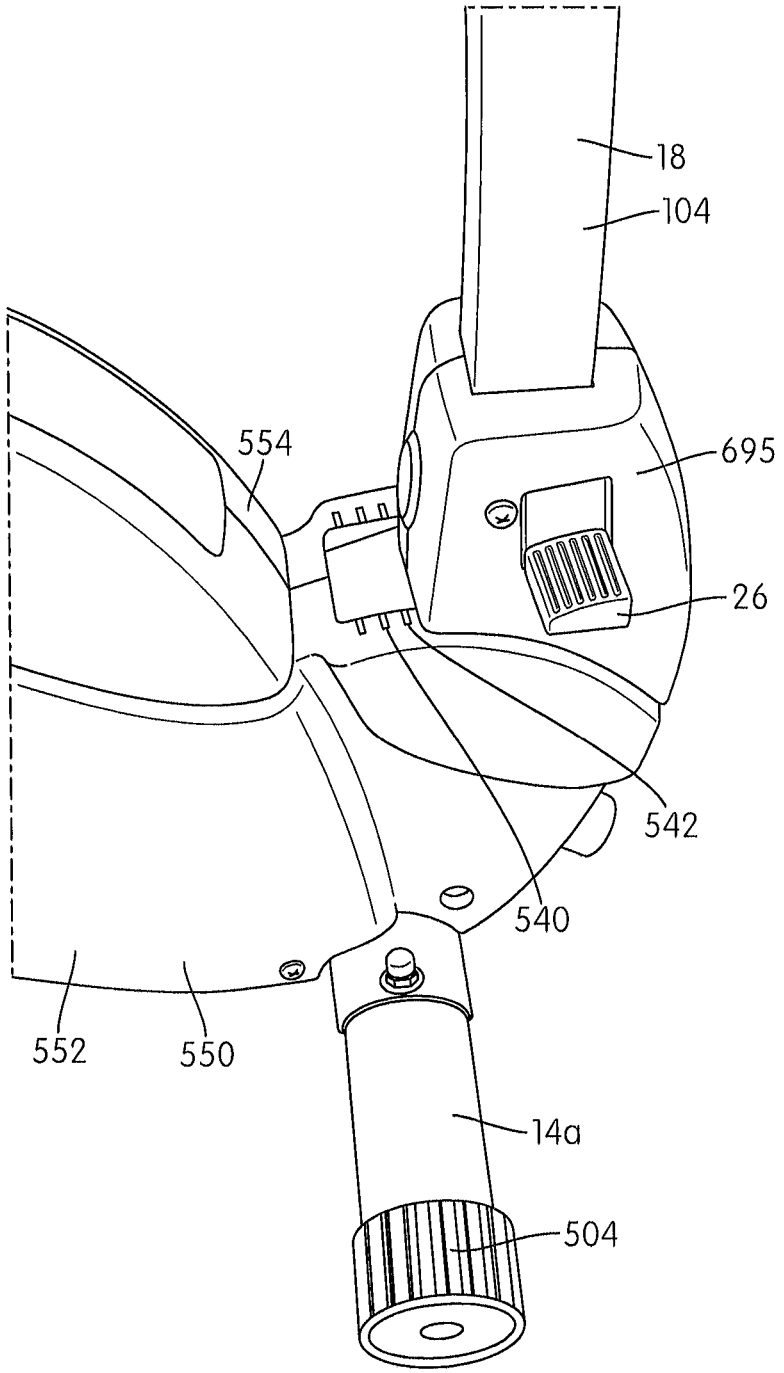
FIG. 8 shows a partial, left side perspective view of the exercise device, where the actuator is in a position to allow for the adjustment of the second frame member to a desired position in accordance with an embodiment of the present patent application.
Figure 9:
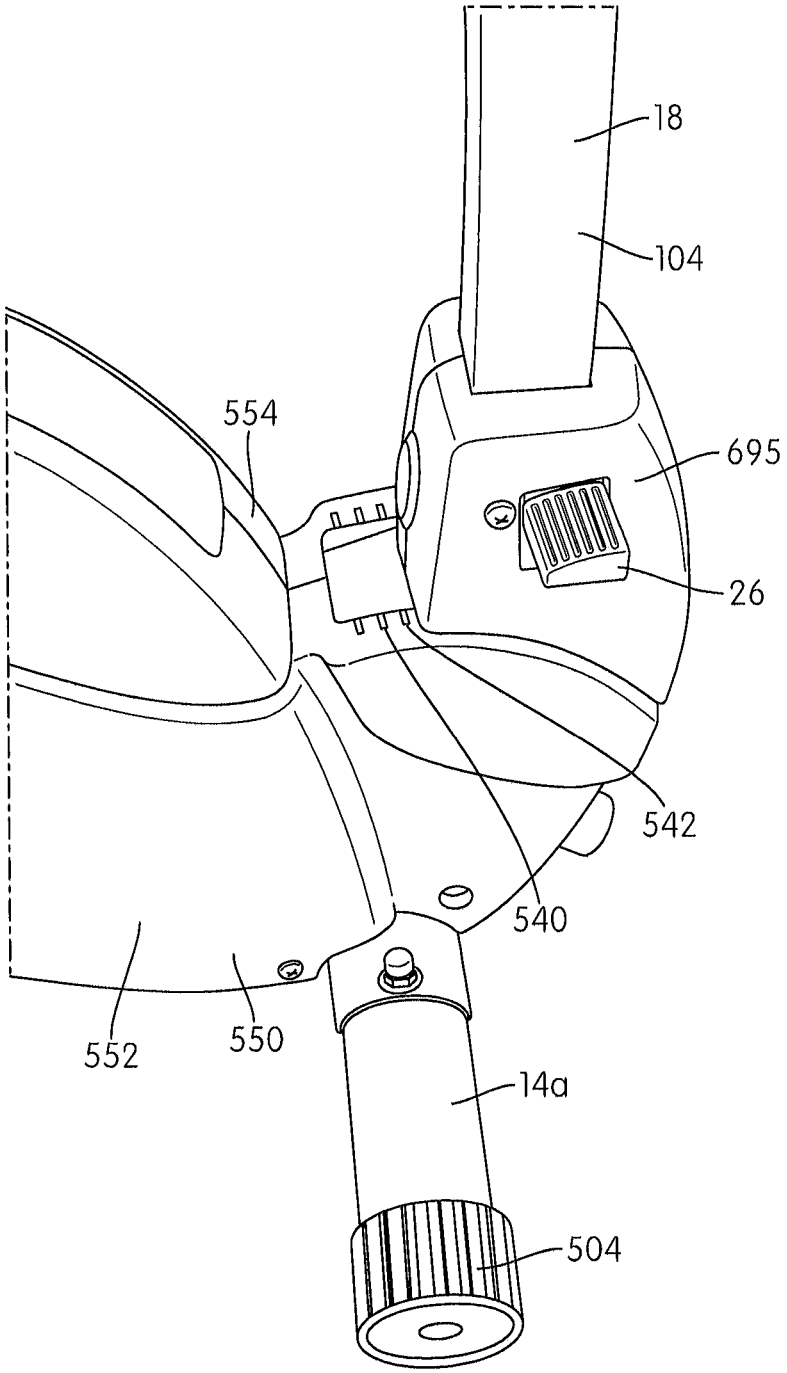
FIG. 9 shows a partial, left side perspective view of the exercise device, where the actuator is in a lock position to lock the second frame member in the desired position in accordance with an embodiment of the present patent application.

The adjustable desk 24 is constructed and arranged to be operatively connected to the second frame member 18. The second frame member 18 is configured to movable between a first position (as shown in FIGS. 3 and 4; Position 5 as shown in FIG. 6) in which the desk 24 is positioned closer to the seat 20 so as to allow the user U seated on the seat 20 to use the desk 24 and a second position (as shown in FIG. 5; Position 1 as shown in FIG. 6) in which the desk 24 is positioned away from the seat 20 so as to allow the user U to stand upright on the surface 15 with the user's body positioned between the seat 20 and the desk 24 to use the desk 24 in a standing position. The actuator 26 is constructed and arranged to be operatively associated with the second frame member 18 and actuated to enable the second frame member 18 to be moved between the first position and the second position.

In one embodiment, the exercise device 10 may be 37.25 inches long, 27.5 inches wide, and 45.5 inches tall. In one embodiment, the exercise device 10 may be 44.7 inches long, 33 inches wide, and 54.6 inches tall. In one embodiment, the exercise device 10 may be 29.8 inches long, 22 inches wide, and 36.4 inches tall. In one embodiment, the exercise device 10 may be 40.98 inches long, 30.25 inches wide, and 50.1 inches tall. In one embodiment, the exercise device 10 may be 33.525 inches long, 24.75 inches wide, and 40.95 inches tall.

In one embodiment, the exercise device 10 may be 45 inches long, 21,7 inches wide, and 45.7 inches tall. In one embodiment, the exercise device 10 may be 54 inches long, 26.04 inches wide, and 54.84 inches tall. In one embodiment, the exercise device 10 may be 36 inches long, 17.36 inches wide, and 36.56 inches tall. In one embodiment, the exercise device 10 may be 49.5 inches long, 23.87 inches wide, and 50.27 inches tall. In one embodiment, the exercise device 10 may be 40.5 inches long, 19.53 inches wide, and 41.13 inches tall. In one embodiment, these dimensions of the exercise device 10 may vary. For example, in one embodiment, these dimensions may vary up to an inch.

In one embodiment, the exercise device 10 may weigh 45.25 pounds. In another embodiment, the weight of the exercise device 10 may vary. In one embodiment, the exercise device 10 may weigh 54.3 pounds. In one embodiment, the exercise device 10 may weigh 36.2 pounds. In one embodiment, the exercise device 10 may weigh 49.78 pounds. In one embodiment, the exercise device 10 may weigh 40.73 pounds.

In one embodiment, the exercise device 10 may have a weight limitation not exceeding 300 pounds or 136 kilograms. In one embodiment, the exercise device 10 may have a weight limitation not exceeding 360 pounds or 163 kilograms. In one embodiment, the exercise device 10 may have a weight limitation not exceeding 240 pounds or 109 kilograms. In one embodiment, the exercise device 10 may have a weight limitation not exceeding 330 pounds or 150 kilograms. In one embodiment, the exercise device 10 may have a weight limitation not exceeding 269 pounds or 122 kilograms. In another embodiment, the weight limitation of the exercise device 10 may vary.

In one embodiment, the exercise device 10 may include a housing assembly 550 made of an appropriate metal (such as aluminum or steel) or other material of suitable strength. In one embodiment, the housing assembly 550 may be made of molded plastic material. In one embodiment, the housing assembly 550 may include two mating portions, first housing portion 552 and second housing portion 554. In one embodiment, the first and second housing portions 552 and 554 are secured together to form the housing assembly 550 by a threaded or other type of conventional fastener. In one embodiment, the first and second housing portions 552 and 554 cooperate to define an interior space that is configured to receive the crank pedal mechanism 22 therein.

In one embodiment, the exercise device 10 is configured to be positionable on the surface 15. In one embodiment, the surface 15 may be any support surface. For example, the surface 15 may be a ground support surface, such as a floor. In one embodiment, the surface 15 may be a surface of an equipment mat (e.g., placed on the floor) on which the exercise device 10 is placed.

In one embodiment, the frame assembly 12 may be made of a steel material. In one embodiment, the frame assembly 12 may be made of any other suitable material or combination of materials having sufficient durability to permit the user U exercise while maintaining structural stability of the exercise device 10.

In one embodiment, members 14, 16 and 18 of the frame assembly 12 may be hollow tubular members, having apertures therein to receive connecting fasteners, such as screws, bolts, or other connecting members. In another embodiment, the members 14, 16 and 18 of the frame assembly 12 may be connected to each other by removable fasteners such that the members 14, 16 and 18 are detachable for ease of packaging or other space-saving storage, In yet another embodiment, some of the members 14, 16 and 18 of the frame assembly 12 may be permanently fastened to one another, through welding, one-way fasteners, or so on, In one embodiment, the members 14, 16 and 18 of the frame assembly 12 may have circular, square or rectangular cross sectional configurations. In another embodiment, the members 14, 16 and 18 of the frame assembly 12 may have other shaped cross sectional configurations for ease of manufacture and/or to provide desired structural strength. In one embodiment, some members 14, 16 and 18 of the frame assembly 12 may have one shaped cross sectional configuration, while other members 14, 16 and 18 of the frame assembly 12 may have other shaped cross sectional configurations.

In one embodiment, the base portion 14 may include a front stabilizer member 14*a* and a rear stabilizer member 14*b*. In one embodiment, the front and rear stabilizer members 14*a* and 14*b* may be referred to as foot support portions (or support portions) of the base portion 14. In one embodiment, the front and rear stabilizer members 14*a* and 14*b* of the base portion 14 are configured to engage the surface 15 and support the exercise device 10 on the surface 15.

Figure 13:
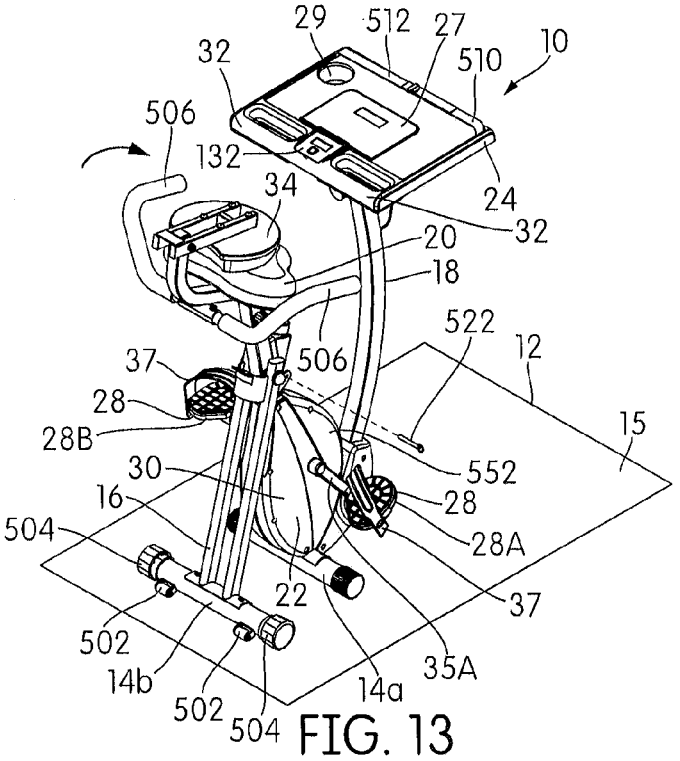

In one embodiment, the rear stabilizer member 14*b* may include wheels 502 or other rolling members that are configured to facilitate rolling movement of the exercise device 10, when in its storage position as shown in FIG. 13, on the surface 15. In one embodiment, the wheels 502 or other rolling members may be attached to or connected with the rear stabilizer member 14*b* by any coupling members such as pins, rods, screws, bolts, and/or other coupling members/mechanisms. In one embodiment, the user U may tip exercise device 10 up onto the wheels 502 and then roll the exercise device 10 across the floor surface 15 using the wheels 502 when the exercise device 10 in its storage position as shown in FIG. 13.

In one embodiment, the front and rear stabilizer members 14*a* and 14*b* may each include leveling caps 504 provided at their end portions. In one embodiment, the leveling caps 504 may be configured to enable the exercise device 10 be placed firmly on the floor/surface 15 without rocking, In one embodiment, one or both of the leveling caps 504 may be adjusted or turned until the rocking motion of the exercise device 10 on the floor/surface 15 is eliminated. In one embodiment, the leveling caps 504 may be configured to compensate for any unevenness of the surface 15 and/or any misalignment of the members 14, 16 and 18 of the frame assembly 12.

In another embodiment, the front and rear stabilizer members 14*a* and 14*b* may each include end caps provided at their end portions or extremities. In one embodiment, the end caps are made of plastic, rubber, felt, cloth, or other similar material, so as to reduce incidence of scratching, cutting, or other from metalwork in forming the metal tubes 14*a* and 14*b*, for example. In one embodiment, the end caps are configured to prevent scratching of the support surface 15, or increase friction on the support surface 15 to prevent shifting or sliding of the exercise device 10 while performing the exercise.

In one embodiment, the base portion 14 may include support member(s) 14*c*. In one embodiment, the support member(s) 14*c* may be referred to as a rear frame of the exercise device 10. In one embodiment, the support member(s) 14*c* and the rear stabilizer member 14*b* may together be referred to as a rear frame of the exercise device 10.

In one embodiment, the support member(s) 14*c* are configured to connect the first frame member 16 to the rear stabilizer member 14*b* of the base portion 14. In illustrated embodiment, the base portion 14 includes two parallel, spaced apart support members 14*c*. In another embodiment, the support member(s) 14*c* of the exercise device 10 may be part of the first frame member 16.

In one embodiment, the first frame member 16 and the front stabilizer member 14*a* may together be referred to as a front frame or a main frame of the exercise device 10.

In one embodiment, the first frame member 16 and the second frame member 18 may be connected to and supported by the base portion 14. In one embodiment, the first frame member 16 and the second frame member 18 each have a first end portion 16*a* and 18*a* and a second end portion 16*b* and 18*b*. In one embodiment, the first frame member 16 and the second frame member 18 are connected to the base portion 14 at or near their respective first end portions 16*a* and 18*a*.

In one embodiment, the first frame member 16 and the second frame member 18 may be connected to and supported by the front stabilizer member 14*a* of the base portion 14. In one embodiment, the first frame member 16 is supported by both the front and rear stabilizer members 14*a* and 14*b* of the base portion 14. For example, in one embodiment, the first frame member 16 is supported by the rear stabilizer member 14*b* of the base portion 14 via the support member(s) 14*c*.

In one embodiment, the first frame member 16 is configured to support the seat 20. In one embodiment, the seat 20 is constructed and arranged to be operatively connected to the second end portion 16*b* of the first frame member 16. In one embodiment, the seat 20 may be padded for the user's comfort. In one embodiment, the exercise device 10 may also include a back rest 34. In one embodiment, the back rest 34 may be padded for the user's comfort. In one embodiment, the padding is optional.

In one embodiment, the back rest 34 is configured to be moved between an upright position (as shown in FIGS. 1-6, 10, 11 and 12) in which the back rest 34 supports the user's back and a storage/folded position (as shown in FIG. 13) in which the back rest 34 is positioned substantially parallel to the seat 20. In one embodiment, the back rest 34 may be locked by a locking mechanism in its upright position and/or in its storage/folded position. In one embodiment, the back rest is optional.

In one embodiment, the exercise device 10 may include a back rest support member 634 (as shown in FIG. 1A) that is configured to support the back rest 34 of the exercise device 10. In one embodiment, the back rest support member 634 is configured to be connected to the first frame member 16 via another support member 636 (as shown in FIG. 1A). In one embodiment, the support member 636 is also configured to connect hand grips 506 (as described in detail below) to the exercise device 10.

In one embodiment, the exercise device 10 may include a seat telescopic mechanism 112 having a stationary member 114 and a movable member 116. In one embodiment, the stationary member 114 and the movable member 116 may be part of the first frame member 16. In one embodiment, the seat 20 is attached to the movable member 116 of the seat telescopic mechanism 112 and is configured to move and be adjusted vertically (with respect to the stationary member 114) in a plurality of positions as needed for user's comfort. In one embodiment, the exercise device 10 may include a seat height lock mechanism 118 that is configured to lock the seat 20 at a predetermined or desired height/position. In one embodiment, the seat height lock mechanism 118 may be in the form of an adjustment knob. In one embodiment, the height of the seat 10 may be adjustable to fit the user's ideal pedaling position.

For example, in one embodiment, the adjustment knob 118 is turned to loosen the knob 118. The adjustment knob 118 is then pulled to release its pin from one of the plurality of holes of the movable member 116. The seat 20 and the movable member 116 are then slid until the seat 20 is at the user desired position. The adjustment knob 118 is then released such that its pin engages with one of the plurality of holes of the movable member 116. After adjusting the seat 20 to the desired position and locking the seat 20 at the desired position (by engaging its pin with one of the plurality of holes of the movable member 116), the adjustment knob 118 is tightened by the user.

In one embodiment, the exercise device 10 may include the hand grips 506. In one embodiment, the hand grips 506 are constructed and arranged to be gripped by the user's hands while exercising. In one embodiment, the hand grips 506 may be connected to the exercise device 10 using the support member 636. In one embodiment, the hand grips 506 may be of any appropriate construction or configuration, including in some embodiments, being formed from, containing, or being wrapped in a generally soft or otherwise padded material, to facilitate user comfort. In one embodiment, the hand grips 506 may be coated with an ergonomic material to enhance the ability of the hand grips 506 to engage the user's hand. Examples of such an ergonomic material include a high friction material for enhanced grip and/or a spongy material to provide for a padded grip. In one embodiment, the hand grips 506 on the first frame member 16 may be foam grips. In one embodiment, the hand grips 506 are optional.

In one embodiment, the second frame member 18 is configured to support the adjustable desk 24. In one embodiment, the adjustable desk 24 is constructed and arranged to be operatively connected to the second end portion 18*b* of the second frame member 18.

In one embodiment, the adjustable desk 24 has a work surface 25. In one embodiment, the work surface 25 of the adjustable desk 24 may have dimensions of 17.25 inches by 10 inches. In another embodiment, the dimensions of the work surface 25 of the adjustable desk 24 may vary. In one embodiment, the adjustable desk 24 may have a weight limitation not exceeding 30 pounds or 13.6 kilograms. In another embodiment, the weight limitation of the adjustable desk 24 may vary. In one embodiment, the work surface 25 of the adjustable desk 24 may be configured to receive user's laptop 508 thereon. In one embodiment, the work surface 25 of the adjustable desk 24 may be configured to receive user's documents thereon.

Figure 10:
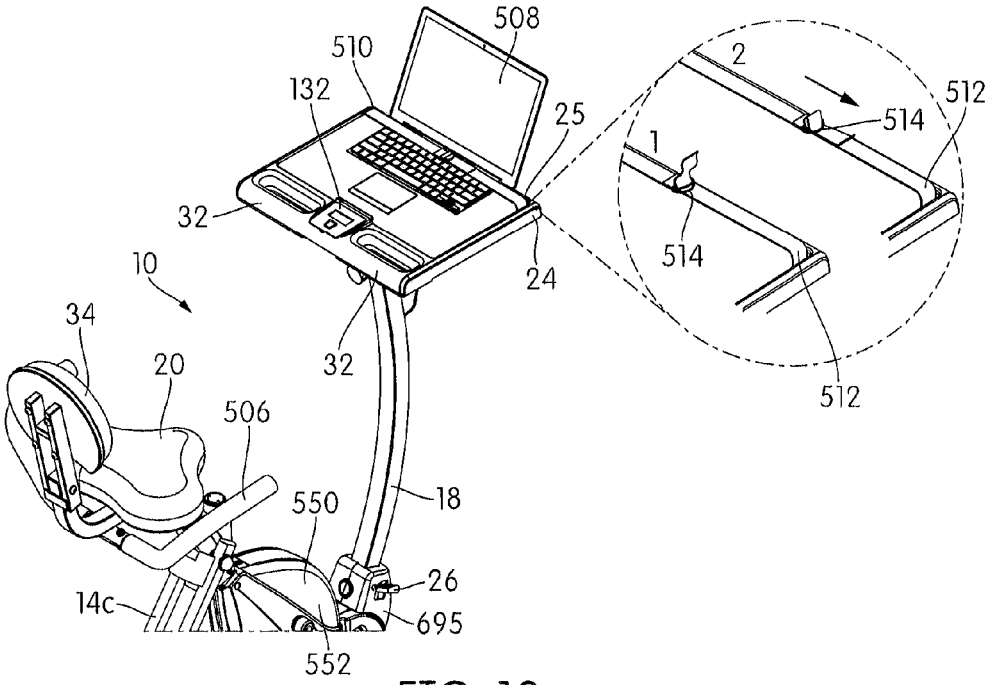
FIG. 10 shows a partial, left side perspective view of the exercise device, where a laptop is positioned on and secured to its adjustable desk and where the detailed views of FIG. 10 show laptop securement members for securing the laptop to the adjustable desk in accordance with an embodiment of the present patent application.

In one embodiment, as shown in FIG. 10, the exercise device 10 may include laptop securement assembly 510 configured to releasably secure the laptop 508 to the work surface 25 of the adjustment desk 24. In one embodiment, the laptop securement assembly 510 may include a strap 512 and two D-rings 514. In one embodiment, as shown in the detailed view 1 of the FIG. 10, the strap 512 may be run through the two D-rings 514 so as to releasably secure the laptop 508 to the work surface 25 of the adjustment desk 24. In one embodiment, as shown in the detailed view 2 of the FIG. 10, the strap 512 may be run into the gap between the two D-rings 514, then go through the other D-ring 514. In one embodiment, the strap 512 is then pulled to tighten the laptop securement assembly 510 so as to releasably secure the laptop 508 to the work surface 25 of the adjustment desk 24.

Figure 11:
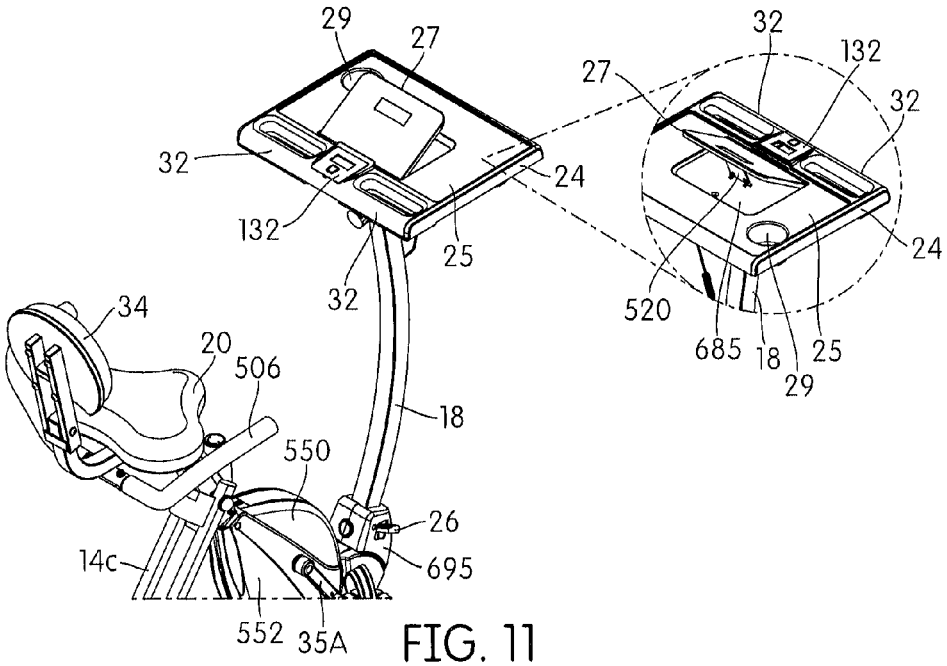
FIG. 11 shows a partial, left side perspective view of the exercise device, where a tablet holder is configured to support a tablet at a desired angle on a work surface of the adjustment desk and where the detailed view of FIG. 11 shows a tablet holder support member that supports the tablet holder from the back in accordance with an embodiment of the present patent application.

In one embodiment, as shown in FIGS. 3, 4, and 11, the adjustable desk 24 may include an adjustable tablet/book holder 27 thereon. In one embodiment, the adjustable tablet/book holder 27 is configured to receive and support a tablet 31 or a book thereon. In one embodiment, the tablet/book holder 27 is configured to support the tablet 31 at a desired viewing angle on the work surface 25 of the adjustment desk 24. In one embodiment, the tablet/book holder 27 is configured to support and position the tablet 31 at a plurality of viewing angles with respect to the work surface 25 of the adjustment desk 24.

In one embodiment, the adjustable tablet/book holder 27 is configured to be movable between a flat configuration in which the adjustable tablet/book holder 27 is positioned substantially parallel to the work surface 25 of adjustable desk 24 and a plurality of angled viewing configurations in which the adjustable tablet/book holder 27 and the tablet 31 or book positioned thereon are configured to be substantially inclined with respect to the work surface 25 of adjustable desk 24 so as to provide multiple viewing configurations or positions for the tablet 31.

In one embodiment, the adjustable tablet/book holder 27, when in the flat configuration, is constructed and arranged to be receive in a notch 685 (as shown in FIG. 4) formed in the adjustable desk so that the surface of the adjustable tablet/book holder 27 is flush with the work surface 24 as clearly shown in FIG. 2. In one embodiment, the surface of the adjustable tablet/book holder 27, when in the flat configuration, may form part of the work surface 24.

In one embodiment, as shown in the detailed view of the FIG. 11, the exercise device 10 may include a tablet holder support member 520 is constructed and arranged to support the tablet holder 27 from the back. In one embodiment, the tablet holder support member 520 is hingedly connected to the back surface of the tablet holder 27. In one embodiment, the tablet holder support member 520 is constructed and arranged to engage with one or more slots on the adjustment desk 24 to support tablet holder 27 in its angled configuration(s). In another embodiment, the tablet holder support member 520 is hingedly connected to the adjustment desk 24 and is constructed and arranged to engage with one or more slots on the back surface of the tablet holder 27 to support tablet holder 27 in its angled configuration(s). In other embodiments, the tablet holder support member 520 may have other shapes and configurations as would be appreciated by one skilled in the art.

In one embodiment, the adjustable desk 24 may include a beverage holder 29 that is configured to receive and to secure a beverage container (e.g., a cup or a bottle) to the adjustable desk 24. In one embodiment, the beverage holder 29 is integrally molded with the adjustable desk 24.

In one embodiment, the adjustable desk 24 may also include hand grips 32. In one embodiment, the hand grips 32 are constructed and arranged to be gripped by the user's hands while exercising. In one embodiment, the hand grips 32 are integrally molded with the adjustable desk 24. In one embodiment, the hand grips 32 on the adjustable desk 24 may be padded for the user's comfort. In one embodiment, the hand grips 32 may be of any appropriate construction or configuration, including in some embodiments, being formed from, containing, or being wrapped in a generally soft or otherwise padded material, to facilitate user comfort. In one embodiment, the hand grips 32 may be coated with an ergonomic material to enhance the ability of the hand grips 32 to engage a user's hand. Examples of such an ergonomic material include a high friction material for enhanced grip and/or a spongy material to provide for a padded grip. In one embodiment, the hand grips 32 on the adjustable desk 24 may be foam grips. In one embodiment, the hand grips 32 are optional.

In one embodiment, the adjustable desk 24 may include a fitness monitor 132. The fitness monitor 132 may include one or more other components configured to track time, speed, distance, calories, total distance, and scan function and a display panel configured to display time, speed, distance, calories, total distance, and scan function.

For example, in one embodiment, the exercise device 10 may incorporate a speed/distance sensor, typically a two-part sensor comprising a permanent magnet mounted on the crank pedal assembly 22 and a stationary sensor, such as a Hall Effect sensor, that is capable of registering the increase in magnetic field that occurs when the permanent magnet rotates close to the sensor. The output from the sensor may be displayed (in any desired format or any unit, measured or derived) on the fitness monitor 132. In other embodiments, other speed/distance sensors as would be appreciated by one skilled in the art may be used.

In addition to the functions of the fitness monitor 132 that were described above, including speed/distance measurement, the fitness monitor 132 may also include a variety of other information, and may include some calculating ability, e.g., from an installed microprocessor, ASIC, or other computing device. For example, the display panel of the fitness monitor 132 may display the number of calories expended in exercise, based upon the user's weight (typically input into the display panel by the user), the speed at which the user is moving (as determined by sensors), and the time interval during which the user has been exercising. In addition, the display panel may display the output from biological sensors connected to it. For example, in one embodiment, a pulse meter may be connected to the display panel in some embodiments and its output displayed on the display panel.

In one embodiment, the fitness monitor 132 may include a mode button. In one embodiment, the mode button may be pressed by the user to select display functions, including, time, speed, distance, calories, total distance, and scan function. In one embodiment, pressing and holding the mode button for two seconds may reset all functions to zero (except for the odometer). In one embodiment, the odometer may be reset to zero after batteries of the fitness monitor 132 are removed for battery replacement or storage of the fitness monitor 132.

In one embodiment, the fitness monitor 132 is configured to display the time from 1 second up to 99:59 minutes. In one embodiment, the fitness monitor 132 is configured to display the current speed from 0 to 999.9 miles per hour. In one embodiment, the fitness monitor 132 is configured to display the distance from 0 to 999.9 miles. In one embodiment, the fitness monitor 132 is configured to display the calories burned from 0 to 999.9 Kcal. In one embodiment, the calorie readout is an estimate for an average user. In one embodiment, the fitness monitor 132 is configured to display the total accumulated distance the user have traveled from 0 to 9999 miles. In one embodiment, the total accumulated distance is retained when the fitness meter 132 is turned off. In another embodiment, the ranges of each of the functions displayed on the fitness monitor 132 may vary.

In one embodiment, the exercise device 10 may be powered on by starting the movement of the pedals 28 or by pressing a power on button on the fitness monitor 132. In one embodiment, the exercise device 10 may be powered off by pressing a power off button on the fitness monitor 132 or by stopping the movement of the pedals. In one embodiment, the exercise device 10 may also be configured to automatically shut off after four minutes of inactivity.

In one embodiment, the exercise device 10 may include a desk telescopic mechanism 102 having a stationary portion 104 and a movable portion 106. In one embodiment, the adjustable desk 24 is attached to the movable portion 106 of the desk telescopic mechanism 102 and configured to move and be adjusted vertically in a plurality of positions. In one embodiment, the exercise device 10 may include a desk height lock mechanism 108 that is configured to lock the adjustable desk 24 at a predetermined or desired height. In one embodiment, the desk height lock mechanism 108 may be in the form of an adjustment knob. In one embodiment, the adjustable desk 24, when in the second position, may have a height that ranges between 40 and 44.5 inches. In one embodiment, the operation of the desk height lock mechanism 108 is similar to that of the seat height lock mechanism 118 and is, therefore, not described in detail here.

Referring to FIG. 6, the second frame member 18 is configured to be moved between the first position and the second position via a plurality of intermediate positions. In one embodiment, the first position of the second frame member 18 in which the desk 24 is positioned closer to the seat 20 so as to allow the user seated on the seat 20 to use the desk 24 may be referred to as Position 5 in FIG. 6. In one embodiment, when the second frame member 18 is in the first position, the desk 24 is positioned closer to the seat 20 so as to allow the user seated on the seat 20 and exercising by rotating the pedals 28 to use the desk 24.

In one embodiment, the second position of the second frame member 18 in which the desk 24 is positioned away from the seat 20 so as to allow the user to stand upright on the surface 15 with the user's body positioned between the seat 20 and the desk 24 to use the desk 24 in a standing position may be referred to as Position 1 in FIG. 6. In one embodiment, the desk 24 is slightly away from the seat 20 so that the user in a standing position can use the desk 24. In one embodiment, the user's feet are positioned between the support portions 14*a* and 14*b* of the base portion 14 when the user is standing upright on the surface 15 with the user's body positioned between the seat 20 and the desk 24. In one embodiment, when the second frame member 18 is in the second position, the user can partially straddle the seat 20 when the user is standing upright on the surface 15 with the user's body positioned between the seat 20 and the desk 24.

Positions 2, 3 and 4 in FIG. 6 may be referred to as the plurality of intermediate positions of the second frame member 18. In one embodiment, the second frame member 18 is configured to be locked at each of the first position, the second position and the plurality of intermediate positions. In one embodiment, as shown in FIG. 6, the angle of the adjustable desk 24 may be set to different angles from Position 1 to Position 5.

In one embodiment, as shown in the detailed view of FIG. 6, the exercise device 10 may include a position/angle index or indicator 540 configured for indicating the position/angle of the second frame member 18 to the user. In one embodiment, the position/angle indicator 540 is positioned or disposed at any location on the exercise device 10 such that the user will at all times be informed of the exact position/angle of the second frame member 18. In the illustrated embodiment, the position/angle indicator 540 is positioned or disposed near the first end portion 18*a* of the second frame member 18.

In one embodiment, the position/angle indicator 540 may include a plurality of indicator lines 542 inscribed on the exercise device 10, where each indicator line corresponds to a position (e.g., Positions 1 through 5) of the second frame member 18. For example, the indicator line 542 closer to the seat 20 represents the indicator line for Position 5/the first position of the second frame member 18 and the indicator line 542 that is father away from the seat 20 represents the indicator line for Position 1/the second position of the second frame member 18.

In one embodiment, the crank pedal mechanism 22 may include an adjustable belt tension configured to enable the user to work their leg muscles and to elevate his/her heart rate. In one embodiment, the crank pedal mechanism 22 includes a pair of opposed (right and left) crank arms 35A and 35B connected to the drive system/resistance mechanism 30 to provide resistance to pedaling. In one embodiment, the pedals 28 of the crank pedal mechanism 22 may include a right pedal 28A and a left pedal 28B each associated with corresponding crank arms 35A and 35B. For example, the right pedal 28A is connected to right crank 35A and the left pedal 28B is connected to the left crank 35B.

In one embodiment, the pedals 28 may have foot straps 37 configured to retain the user's foot on the pedals 28. In one embodiment, the foot straps 37 may be configured to be adjustable to accommodate different sized foot or footwear of the user. In one embodiment, the pedals 28 may be textured to keep the user's feet in place while using the exercise device 10. In one embodiment, the pedals 28 may be slip-resistant pedals.

In one embodiment, the resistance mechanism 30 may include ball bearing, fluid, magnetic, mechanical or other resistance generating elements therein. In one embodiment, the exercise device 10 may include a variable resistance enhancer configured to increase an amount of force required to cycle the exercise device 10. The resistance enhancer may include any suitable construction or configuration configured to increase friction against the exercise device 10 and/or increase an amount of force required to cycle the exercise device 10. For example, in one embodiment, the exercise device 10 includes a tension knob 122 that is configured to adjust or change the resistance of the resistance mechanism 30. In one embodiment, the rotation of the tension knob 122 is configured to allow for adjustment of the resistance of the resistance mechanism 30. In one embodiment, the tension knob 122 is turned clockwise direction to increase the load on/friction within the crank pedal mechanism 22 and turned counterclockwise direction to decrease the load on/friction within the crank pedal mechanism 22. In one embodiment, the resistance enhancer may include a friction belt and/or flywheel arrangement. In another embodiment, the resistance enhancer may include a magnetic mechanism or arrangement that is configured to vary the resistance against rotation of the exercise device 10. In yet another embodiment, other resistance enhancers may be utilized, including but not limited to fluid, electrical, mechanical or other mechanisms configured to vary the resistance against rotation of the exercise device 10.

In one embodiment, the exercise device 10 includes a lock assembly that includes a lock structure. In one embodiment, the actuator 26 may be part of the lock assembly. In one embodiment, the lock structure is configured to be movable between a lock position where the lock structure lockingly engages a lock engaging region of the second frame member to lock the second frame member in one of its plurality of positions (e.g., positions 1-5 as shown in FIG. 6), and a release position where the lock structure is released from engagement with the lock engaging region of the second frame member to enable the second frame member to be moved between the first and second positions (via the plurality of intermediate positions, Positions 2, 3, 4 as shown in FIG. 6).

In one embodiment, the actuator 26 is configured to be actuatable to move the lock structure from the lock position to the release position. In one embodiment, the actuator 26 is a manually enagageable actuator. In one embodiment, the actuator 26 is a foot operated actuator. That is, in one embodiment, the actuator 26 is positioned toward the base portion 14 to enable it to be actuated by user's foot. For example, in one embodiment, the actuator 26 is a foot pedal. In one embodiment, the actuator 26 may be a hand-held/operated actuator (e.g., a hand lever) and a cable configured to transmit the force/signal from the hand-held actuator to the lock assembly. In one embodiment, the actuator may be a hand-operated or a foot-operated switch. In one embodiment, the actuator 26 may be disposed at any location on the exercise device 10 such that the actuator 26 is easily accessible to the user seated on the seat 20 or in a standing position.

The operation of the actuator 26 and the lock assembly is discussed. The manually engageable actuator 26 is manually actuated (by lifting) to move the lock structure from the lock position to the release position. For example, in one embodiment, the user may lift the actuator 26 with one foot. When the manually engageable actuator 26 is actuated, the lock structure disengages from the lock engaging region of the second frame member 18. Once the lock structure disengages from the lock engaging region of the second frame member 18, the second frame member 18 may be easily moved between the first position (position 5 as shown in FIG. 6) and the second position (position 1 as shown in FIG. 6), for example, via the plurality of intermediate positions (Positions 2, 3, 4 as shown in FIG. 6). Once the second frame member 18 is in a user desired position (e.g., Positions 1 through 5 as shown in FIG. 6), the user may press the actuator 26 down to its original position. This action returns the lock structure to the lock position in which the lock structure lockingly engages the lock engaging region of the second frame member 18 to lock the second frame member 18 in that user desired position.

In one embodiment, the lock structure may be a spring biased lock structure. The spring of the lock assembly is compressed as the lock structure is moved from the lock position to the release position (by manually actuating the actuator 26). In one embodiment, the spring of the lock assembly is constructed and arranged to return the lock structure to the lock position or bias the lock structure towards the lock position. Once the second frame member 18 is in a user desired position (e.g., Positions 1 through 5 as shown in FIG. 6), the spring returns the lock structure to the lock position in which the lock structure lockingly engages the lock engaging region of the second frame member 18 to lock the second frame member 18 in that position. In one embodiment, the actuator 26 is returned to its rest/original position by the spring.

In one embodiment, the exercise machine 10 may include a housing 695 having an interior space that is configured to receive the lock assembly therein. In one embodiment, the housing 695 may have an aperture or opening to allow the actuator 26 to pass through so that the actuator 26 is accessible from the outside the housing 695 to the user.

In one embodiment, the adjustable desk 24 is configured to be easily pushed away from the seat 20 by pushing up on the release/actuator 26 with the user's foot and gently pushing away the adjustable desk 24.

Figure 12:
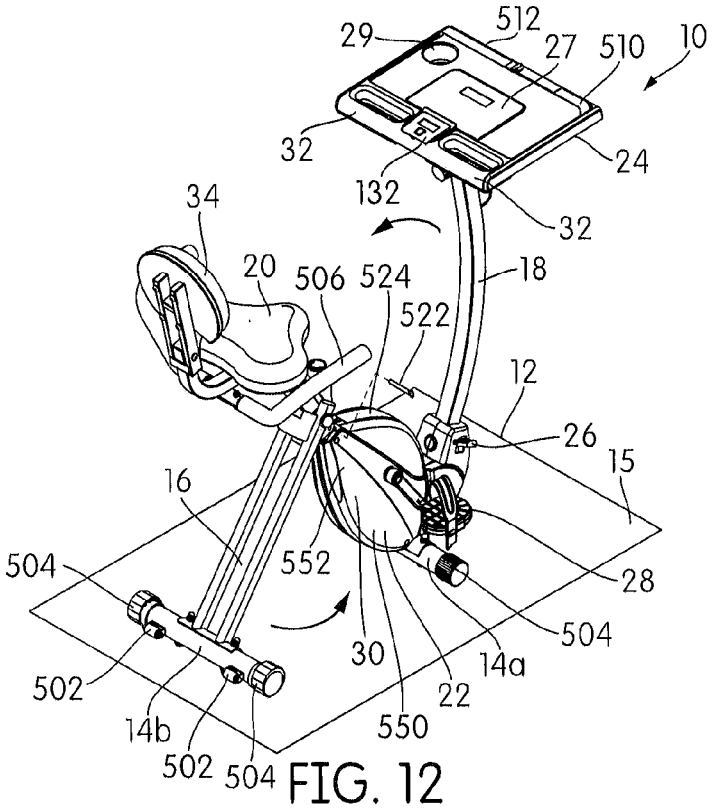
FIGS. 12 and 13 show left side perspective views of the exercise device, where the exercise device is moved from a use position in FIG. 12 to a storage position in FIG. 13 in accordance with an embodiment of the present patent application.

In one embodiment, as shown in FIGS, 12 and 13, the exercise device 10 may be configured to be moved between the use position (as shown in FIG. 12) and a storage position (as shown in FIG. 13). In one embodiment, the use position may be referred to a position of the exercise device 10 in which the second frame member 18 may be in one of its positions (e.g., Positions 1 through 5 in FIG. 6).

To move the exercise device 10 from the use position (as shown in FIG. 12) to the storage position (as shown in FIG. 13), in one embodiment, the user verifies whether the second frame member 18 is in its first position (e.g., position 5 in FIG. 6). If not, the user actuates the actuator 26 to move the second frame member 18 to its first position (e.g., position 5 in FIG. 6).

In one embodiment, the user may then remove a connector member (e.g., a pin) 522 from the support member **14*c*. Removing the connector member or pin 522 from the support member 14*c* allows the support member 14*c* and the rear stabilizer member 14*b* connected thereto to move and fold close to the main or front frame (i.e., the front stabilizer member 14*a* and the first frame member 16). Once the support member 14***c* and the rear stabilizer member 14*b* are moved and folded close to the front stabilizer member 14*a* and the first frame member 16, the connector member or pin 522 is placed back in the support member 14*c* to lock the support member 14*c* and the rear stabilizer member 14*b* in that folded position. In one embodiment, the connector member or pin 522 is configured to extend through both sides of the support member(s) 14*c* and the first frame member 16 when the connector member or pin 522 is in a locked configuration. When in the locked configuration, the connector member or pin 522 is configured to lock both the support member 14*c* and the rear stabilizer member 14*b* either in their folded/storage positions or in their extended/normal/usage positions. In one embodiment, the minimum folded dimensions of the exercise device 10 are approximately 31.8 inches long×21.7 inches wide×40.4 inches tall. In one embodiment, the minimum folded dimensions of the exercise device 10 may vary. In one embodiment, the back rest 34 may be placed in its storage position when the exercise device 10 is moved to the storage position (as shown in FIG. 13).

In one embodiment, the user may move the folded exercise device or the exercise device in the storage position to a desired location by holding the hand grips 506 and tilting the exercise device 10 onto the wheels/rolling members 502 of the rear stabilizer member 14*b*. In one embodiment, the user may remove the batteries of the exercise device 10 before storing the exercise device 10 so as to avoid any damage to the electronics of the exercise device 10.

In one embodiment, to move the exercise device 10 from the storage position (as shown in FIG. 13) to the use position (as shown in FIG. 12), the user may remove the connector member (e.g., a pin) 522 from the support member 14*c*. Removing the connector member or pin 522 from the support member 14*c* allows the support member 14*c* and the rear stabilizer member 14*b* connected thereto to move and extend away to the front stabilizer member 14*a* and the first frame member 16. Once the support member 14*c* and the rear stabilizer member 14*b* are moved and extended away to the front stabilizer member 14*a* and the first frame member 16, the connector member or pin 522 is placed back in the support member 14*c* to lock the support member 14*c* and the rear stabilizer member 14*b* in that extended position.

In one embodiment, the exercise device 10 of the present patent application is configured to allow the user to work and exercise at the same time. In one embodiment, the exercise device 10 of the present patent application is configured to provide cardiovascular fitness and to tone the user's lower body. In one embodiment, the exercise device 10 of the present patent application is not a freewheeling exercise bike, therefore, pedal speed should be reduced in a controlled manner.

One skilled in the art will understand that the embodiment of the exercise device shown in the figures and described above is exemplary only and not intended to be limiting. It is within the scope of the present disclosure to provide any known exercise device with any or all of the features of the present disclosure. For example, the adjustable desk constructed according to the principles of the present disclosure can be applied to any known exercise device. Although embodiments of the present patent application are described with respect to a stationary cycling device/stationary bike, it is contemplated that any or all of the features of the present disclosure are applicable to other exercise devices such as elliptical exercise devices, cross training exercise devices or stair climbing devices.

The portions, weights, weight limitations and dimensions of various parts of the exemplary exercise device as shown and described here are intended to be merely exemplary and not limiting in any way. The various parts of the exemplary exercise device are drawn to scale in accordance with one embodiment, although other scales and shapes may be used in other embodiments. The dimensions of various parts of the exemplary exercise device are measured in inches unless indicated otherwise. The weights of various parts of the exemplary exercise device are measured in pounds or kilograms unless indicated otherwise.

In one embodiment, the weights, weight limitations, and dimensions of various parts of the exemplary exercise device, as shown and described here, are up to 5 percent greater than or up to 5 percent less than those illustrated and described. In another embodiment, the weights, weight limitations, and dimensions of various parts of the exemplary exercise device, as shown and described here, are up to 10 percent greater than or up to 10 percent less than those illustrated and described. In yet another embodiment, the weights, weight limitations, and dimensions of various parts of the exemplary exercise device, as shown and described here, are up to 20 percent greater than or up to 20 percent less than those illustrated and described.

It should also be noted that orientational references, such as "upper", "lower", "right", "left", and the like are used for convenience purposes to refer to the orientation with respect to the Figures. These terms are not intended to be limiting, and in practice the various structures may have other orientations. Any patents or applications referred to in this present patent application, including any in the Background section, are incorporated by reference in their entirety into the present patent application.

Although the present patent application has been described in detail for the purpose of illustration, it is to be understood that such detail is solely for that purpose and that the present patent application is not limited to the disclosed embodiments, but, on the contrary, is intended to cover modifications and equivalent arrangements that are within the spirit and scope of the appended claims. In addition, it is to be understood that the present patent application contemplates that, to the extent possible, one or more features of any embodiment can be combined with one or more features of any other embodiment.

What is claimed is:

1. An exercise device comprising:

a frame assembly having a base portion constructed and arranged to engage a surface, a first frame member and a second frame member;

wherein the first frame member and the second frame member are connected to the base portion;

a seat constructed and arranged to be operatively connected to the first frame member and to support a user in a seated position;

a backrest constructed and arranged to support the back of the user when the user is in the seated position;

a crank pedal mechanism having pedals constructed and arranged to be movably connected to the frame assembly and to support the foot of the user, and a resistance mechanism constructed and arranged to be disposed on the frame assembly and apply resistance to the pedals; and an adjustable desk constructed and arranged to be operatively connected to the second frame member, wherein the second frame member is configured to movable between a first position in which the desk is positioned closer to the seat and the backrest so as to allow the user seated on the seat and the supported by the backrest to use the desk in the seated position and a second position in which the desk is positioned away from the seat and the backrest so as to allow the tier to stand upright on the surface with the user's body positioned between the seat and the desk to use the desk in a standing position; and an actuator constructed and arranged to be operatively associated with the second frame member and actuated to enable the second frame member to be moved between the first position and the second position.

2. The exercise device of claim 1, wherein the first frame member and the second frame member each have a first end portion and a second end portion, and wherein the first frame member and the second frame member are connected to the base portion at their respective first end portions.

3. The exercise device of claim 2, wherein the seat is constructed and arranged to be operatively connected to the second end portion of the first frame member.

4. The exercise device of claim 3, wherein the adjustable desk is constructed and arranged to be operatively connected to the second end portion of the second frame member.

5. The exercise device of claim 1, wherein, when the second frame member is in the first position, the desk is positioned closer to the seat so as to allow the user seated on the seat and exercising by rotating the pedals to use the desk.

6. The exercise device of claim 1, wherein the actuator is positioned toward the base portion to enable it to be actuated by user's foot.

7. The exercise device of claim 1, wherein the base portion having device-foot support portions constructed and arranged to engage with the surface.

8. The exercise device of claim 7, wherein user's feet are positioned between the device-foot support portions of the base portion when the user is standing upright on the surface with the user's body positioned between the seat and the desk.

9. The exercise device of claim 8, wherein, when the second frame member is in the second position, the user can partially straddle the seat when the user is standing upright on the surface with the user's body positioned between the seat and the desk.

10. The exercise device of claim 1, wherein the pedals are constructed and arranged to be rotatably connected to the frame assembly.

11. The exercise device of claim 1, wherein the backrest is constructed and arranged to be operatively connected to the first frame member.

12. The exercise device of claim 1, wherein the actuator is configured to change an angle between the second frame member and the first frame member.

13. The exercise device of claim 1, wherein the actuator is configured to adjust an angle of the second frame member with respect to the first frame member.

14. The exercise device of claim 1, wherein, when the second frame member in the first position, the second frame member is positioned at a first angle with respect to the first frame member and, when the second frame member in the second position, the second frame member is positioned at a second angle with respect to the first frame member, and wherein the first angle is different from the second angle.

15. The exercise device of claim 14, wherein the first angle is smaller than from the second angle.

16. The exercise device of claim 1, further comprising an indicator configured to indicate an angle of the second frame member with respect to the first frame member.

17. The exercise device of claim 1, wherein the second frame member is configured to be positioned in a plurality of intermediate positions between the first position and the second position, and wherein the second frame member is configured to be positioned at a different angle with respect to the first frame member in each of the plurality of intermediate positions.

18. The exercise device of claim 17, wherein the adjustable desk is configured to be positioned at a different angle with respect to the surface in each of the plurality of intermediate positions of the second frame member.

19. The exercise device of claim 1, wherein, when the second frame member in the first position, the adjustable desk is positioned at a first angle with respect to the surface and, when the second frame member in the second position, the adjustable desk is positioned at a second angle with respect to the surface, and wherein the first angle is different from the second angle.

* * * * *